US005676195A

United States Patent [19]

Vassilicos

[11] Patent Number: 5,676,195

[45] Date of Patent: Oct. 14, 1997

[54] METHOD OF AND APPARATUS FOR LIMITING INGRESS OF GAS TO INCIPIENT CONTINUOUS CAST SLABS

[75] Inventor: Achilles Vassilicos, Pittsburgh, Pa.

[73] Assignee: USX Corporation, Pittsburgh, Pa.

[21] Appl. No.: 508,261

[22] Filed: Jul. 27, 1995

[51] Int. Cl.[6] ..... B22D 11/10; B22D 41/58

[52] U.S. Cl. ..... 164/475; 164/415; 164/437; 222/603; 222/606

[58] Field of Search ..... 164/475, 488, 164/66.1, 67.1, 415, 259, 437; 222/603, 606, 607

[56] References Cited

U.S. PATENT DOCUMENTS

| | | | |
|---|---|---|---|
| 3,253,307 | 5/1966 | Griffiths et al. | 222/603 X |
| 3,459,346 | 8/1969 | Tinnes | 222/600 X |
| 3,731,912 | 5/1973 | Kutzer | 222/600 |
| 3,838,798 | 10/1974 | Voss | 222/603 |
| 3,887,117 | 6/1975 | Fehling | 222/600 |
| 4,003,561 | 1/1977 | Cudby | 266/220 |
| 4,429,816 | 2/1984 | Thrower | 164/475 X |
| 4,576,317 | 3/1986 | Wenger | 222/600 |
| 4,854,487 | 8/1989 | Ando et al. | 222/606 |
| 5,100,034 | 3/1992 | Russo | 222/600 |
| 5,118,016 | 6/1992 | Eisermann et al. | 222/597 |

FOREIGN PATENT DOCUMENTS

| | | | |
|---|---|---|---|
| 58-50161 | 3/1983 | Japan | 164/475 |
| 59-225862 | 12/1984 | Japan | 164/475 |
| 62-279072 | 12/1987 | Japan | 222/606 |
| 1-309769 | 12/1989 | Japan | 222/603 |

OTHER PUBLICATIONS

Translation of Japanese Patent Publication 59–225862 published Dec. 18, 1984.

*Primary Examiner*—J. Reed Batten, Jr.
*Attorney, Agent, or Firm*—William L. Krayer

[57] ABSTRACT

Ingress of gas such as air through the joint of a pour tube and tube holder of a continuous caster is prevented or inhibited by passing an inert gas into a circumferential channel around the orifice and at the interface of the joint; the gas is evenly distributed within the channel over the entire configuration of a porous refractory insert in the circumferential channel; the porous refractory insert assures even distribution of the gas to the desired location in the joint.

9 Claims, 8 Drawing Sheets

METHOD OF AND APPARATUS FOR LIMITING INGRESS OF GAS TO INCIPIENT CONTINUOUS CAST SLABS

TECHNICAL FIELD

This invention relates to the continuous casting of metal, especially steel, and in particular to the prevention of the ingress of air and other gases such as sealing gas into contact with molten metal at the top of a pouring tube where it is fixed to a tube holder.

BACKGROUND OF THE INVENTION

In the continuous casting of metal, and steel in particular, molten metal is poured from a ladle or tundish through a valve, commonly a slide valve, through a refractory nozzle and into the tube which is partially immersed in the incipient continuous ingot in order to insulate the molten steel from air and other gases. The tube is fixed to a tube holder, which contacts the under side of a slide valve. The present invention addresses the control of the ingress of undesirable gases (the aspiration of air) through the joint between the tube and the tube holder.

Prior to the present invention, the joint between the tube holder and the tube itself was commonly simply mortared. A circumferential steel shroud or shell frequently is used to cover the joint, but such a shell is generally more effective for strengthening the structure than for providing a gas seal. Cracks inevitably develop in the mortar, and the mortared and shrouded joint frequently permits the negative pressures inside the tube to cause the aspiration of air through the joint. A primary problem caused by air is the oxidation of aluminum present in the steel. The formation of alumina at this stage of steel production is highly undesirable.

SUMMARY OF THE INVENTION

The present invention employs a particular assembly for feeding inert gas into the joint between the mating faces of the tube and tube holder. In the interior of the tube holder mating surface, I employ a circumferential channel in which a porous refractory element is placed without occupying the entire depth of the channel, thus providing a circumferential feed passage for the introduction of gas at a more or less equal pressure contacting the porous refractory throughout the channel. Inert sealing gas is fed from outside the shroud, through the tube holder wall, preferably in response to a signal representing the difference in pressure between the circumferential feed passage and the outside ambient pressure. The inert sealing gas is thus able to displace air which may find its way into the joint.

I do not employ mortar on the entire mating surfaces of the joint, as has commonly been the case in the past. Rather, a preferred joint is designed to provide a mortar shelf on the interior surface of the tube and a complementary overhang on the interior surface of the tube holder; the shelf and overhang are maintained approximately one to six millimeters apart when the remaining flat surfaces of the joint are placed together, thus providing room for a circumferentially mortared area. At the interior terminus of the shelf, the tube is cut circumferentially at an upward angle so the mortar will tend not to be spilled into the remainder of the joint; to further assure that it will not, I employ a relief groove at the high end of the circumferential upward angled cut. The purpose of the relief groove in the mortared variation of my invention is to minimize the possibility of mortar and/or steel finding its way into the main joint.

In addition, my preferred assembly requires that the flat portions of the mating joint surfaces be ground flat, i.e. within a tolerance of 0.00125 cm to 0.03 cm—that is, the surface preferably should not vary more than about 0.03 cm throughout its area. Should the circumferential porous refractory project beyond the flat surface of the joint, it should also be ground to effect flush, firm contact around the circumference of the main portion of the joint.

Thus my invention is seen to comprise a circumferential porous refractory placed on the tube holder joint surface, spaced from the interior wall of the tube holder and its exterior wall, and being in contact with a gas feed channel throughout its circumference. The gas feed channel is in turn connected to a source of inert gas, preferably fed in response to a signal which is a function of the difference between the ambient outside pressure and the pressure at the internal wall of the tube and/or the circumferential gas feed passage.

DETAILED DESCRIPTION OF THE INVENTION

Figure 1:
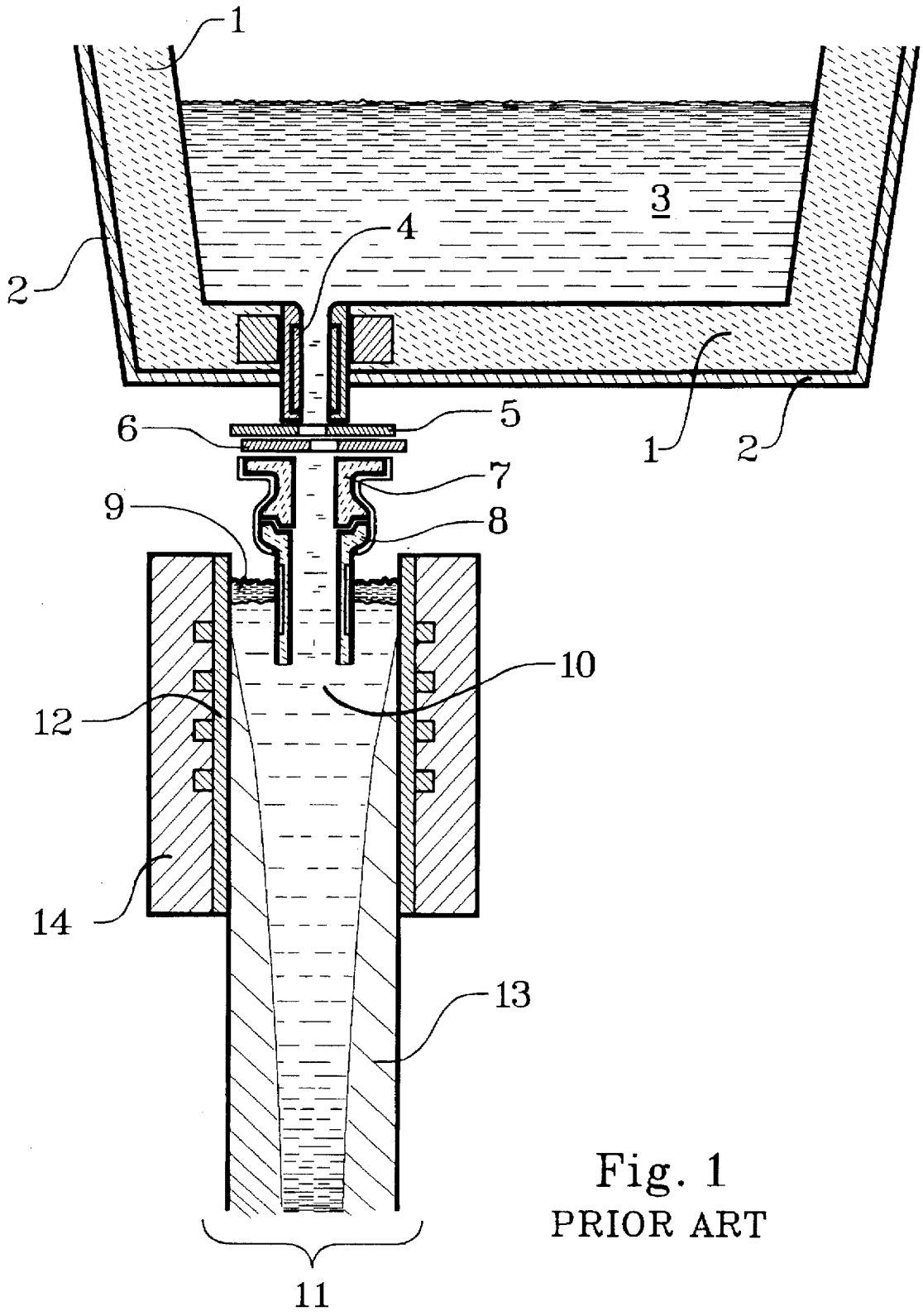
Fig. 1 PRIOR ART

My invention will be illustrated with reference to the drawings, in which:

FIG. 1 is a side sectional, more or less diagrammatic, view of the tundish, nozzle, sliding gate valves, tube holder, pour tube, and mold of a typical prior art continuous casting assembly for molten steel.

Figure 2A:
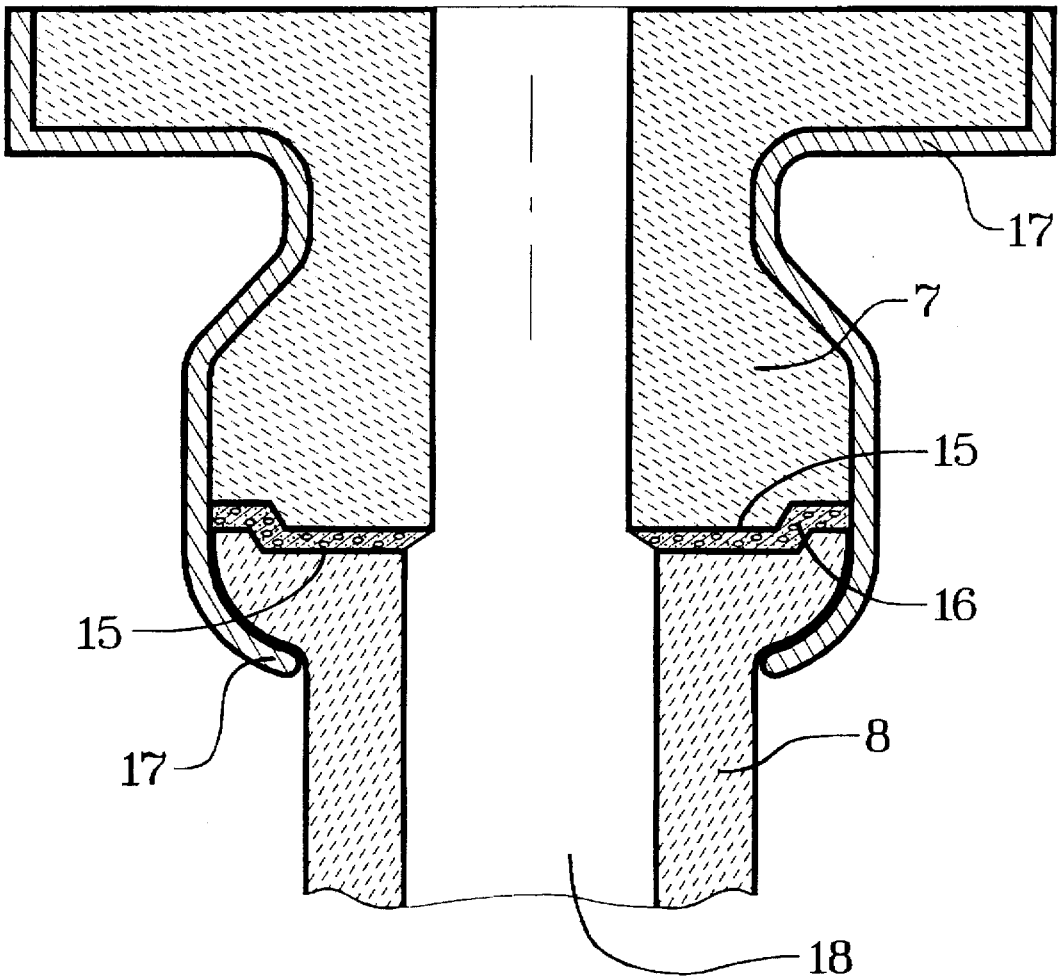
Fig. 2a PRIOR ART
Figure 2B:
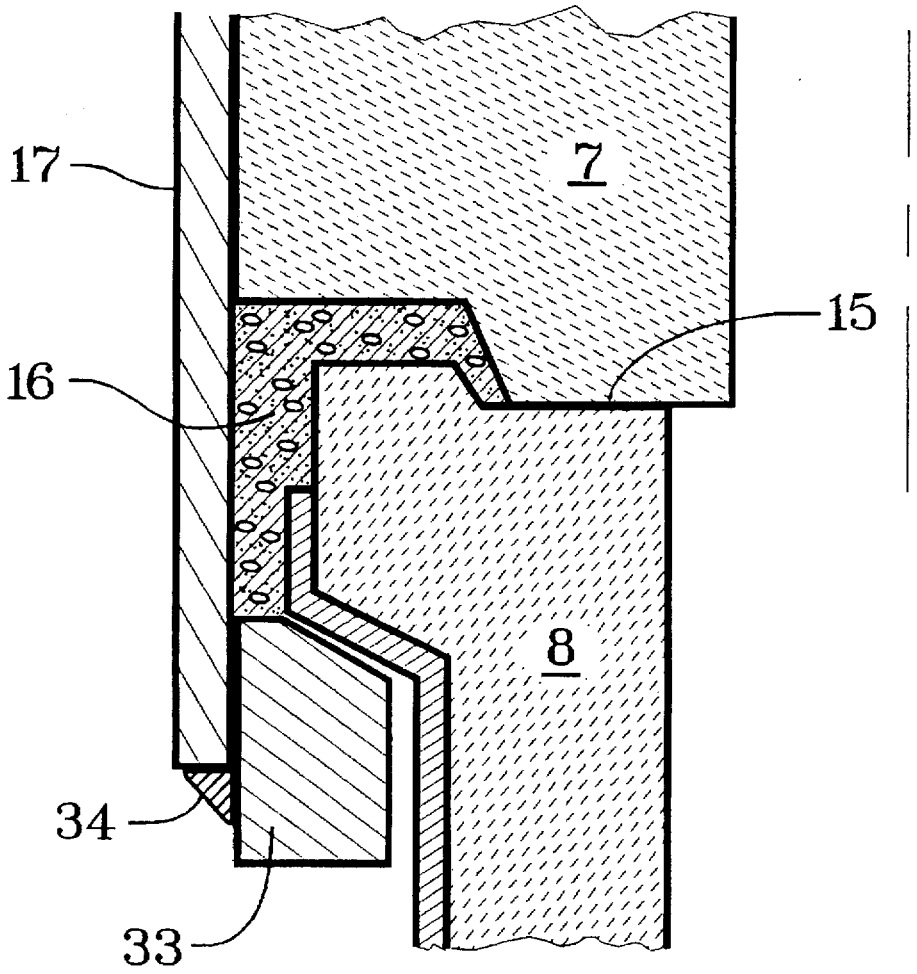
Fig. 2b PRIOR ART

FIG. 2*a* is an enlarged (compared to FIG. 1) side sectional view of a typical prior art joint between a pour tube and tube holder. FIG. 2*b* is a more highly enlarged detail of another prior art variation of the joint showing mortar on the outside of the tube.

Figure 3A:
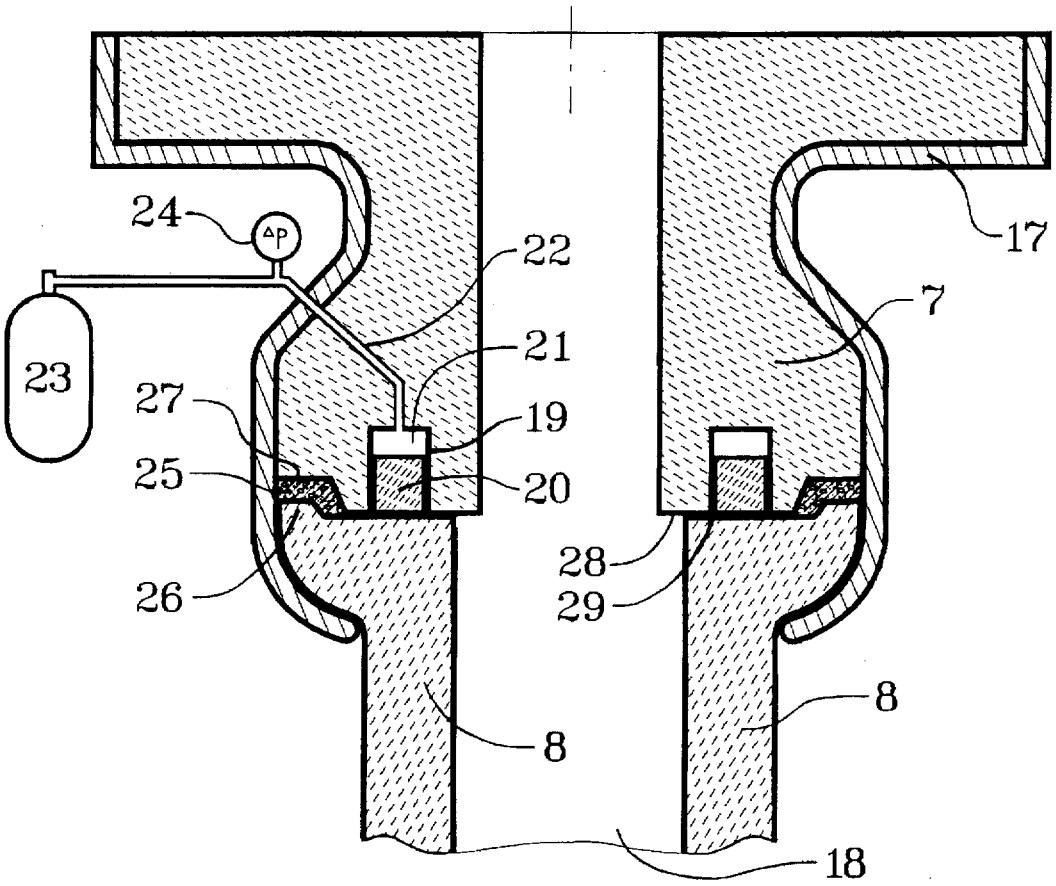
Figure 3B:
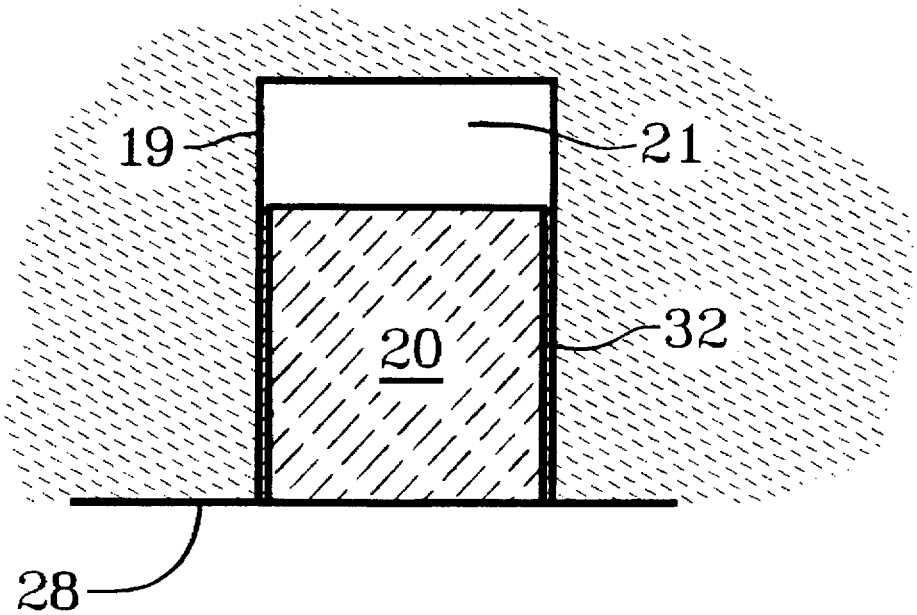

FIG. 3*a* is a side sectional view of a pour tube and tube holder joint of my invention, showing the circumferential porous refractory, and the circumferential gas feed passage. FIG. 3*b* illustrates the sealed fit of the porous refractory in the circumferential channel.

Figure 4A:
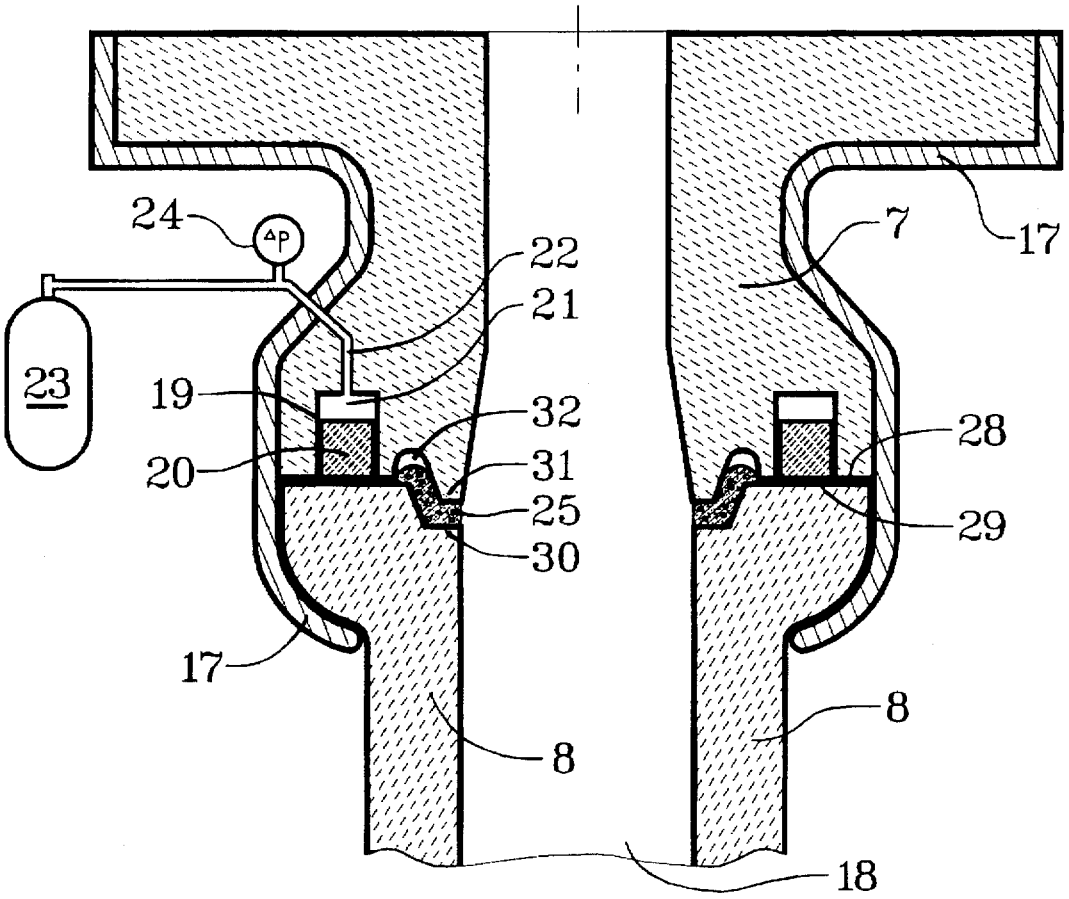
Figure 4B:
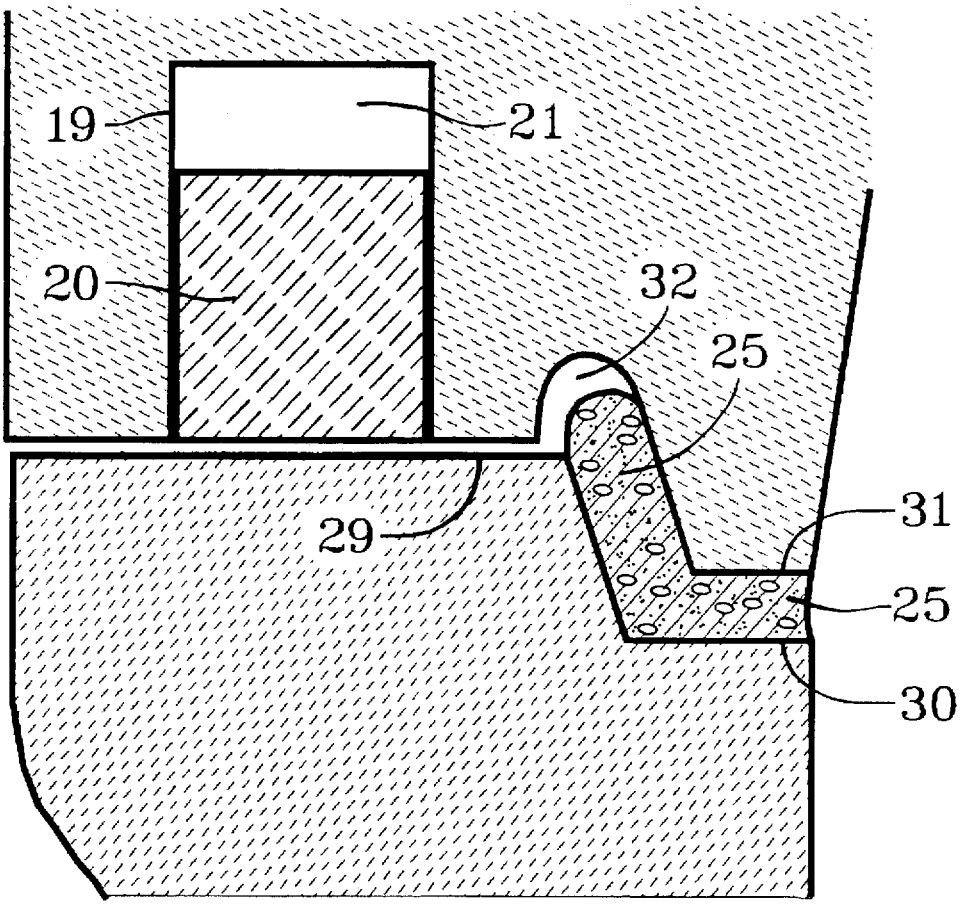

FIG. 4*a* is side sectional view of a different embodiment of my invention, which includes a mortar shelf and a mortar relief groove. FIG. 4*b* shows the preferred extremity of the mortar placement in the joint.

Figure 5:
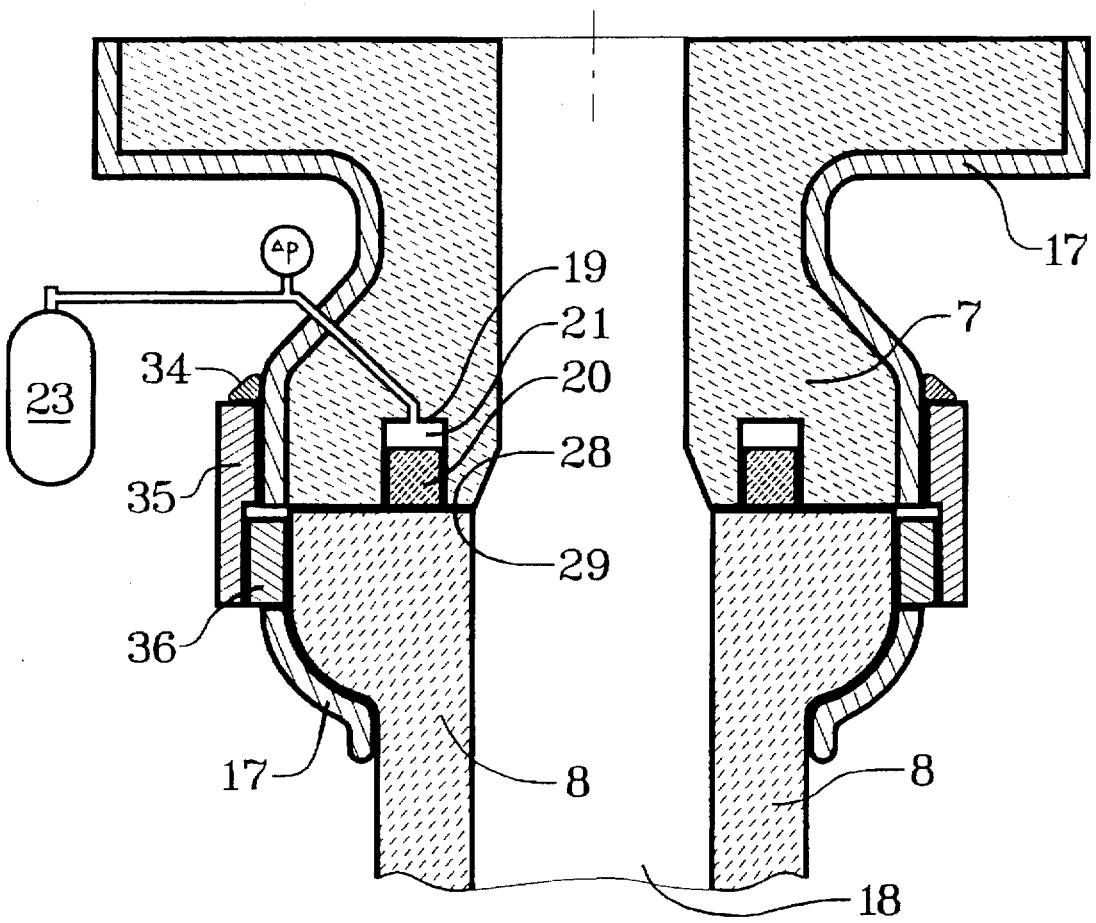

FIG. 5 illustrates that my invention may be used with no mortar in the joint.

In FIG. 1, tundish 2 having a refractory lining 1 contains liquid steel 3 for forming into a continuous cast slab. Control of the flow of steel through refractory nozzle 4 is by a sliding gate valve comprising top plate 5 and slide plate 6 as is known in the art. Directly beneath the slide plate 6 is tube holder 7 and fixed directly beneath it is pour tube 8. In operation, pour tube 8 passes directly through slag layer 9 on the top of the incipient slab 11, which is formed from molten steel 10 deposited near the top of the incipient slab 11 while being exposed to as little atmosphere as possible. Water-cooled copper mold 12 solidifies the steel sufficiently so that by the time it exits mold 12 at its bottom, it has formed a hard shell 13 strong enough to contain the still molten steel 10 in its center. Copper mold 12 is reinforced by a steel envelope 14 around it. The rate of passage of molten steel 3 through the slide plate 6 is controlled so as not to cause an overflow of mold 12 and at the same time to keep up with the solidification and production rates of the slab 11.

FIG. 2*a* shows a conventional joint 15 of a tube holder 7 and a pour tube 8. They are joined by a layer of mortar 16 and enclosed by a steel shroud 17. The mortar tends to develop cracks and otherwise permit the passage of gases into the interior 18 of the tube, and the shroud 17 is typically not made to be gas tight; accordingly gases can easily pass underneath it and gain access to the joint 15. In FIG. 2b, a variation is shown in which mortar 16 extends only part way into the joint 15, but also is employed on the outside of tube 8. This variation also illustrates the commonly used ring 33 surrounding the entire tube 8 and the weld strip 34 which serves as a seal between the ring 33 and the shroud 17. Typically, tight contact of the ring 33 and the tube 8 is assured by holding the ring 33 under compression while the weld strip 34 is secured.

In FIG. 3a, an embodiment of my invention is illustrated, in which circumferential channel 19 is made in the tube holder 7 and partially filled throughout its circumferential form with porous refractory 20, leaving a circumferential gas passage 21. Circumferential gas passage 21 is connected through at least one duct 22 to a source 23 of inert gas such as argon or other suitable gas. Flow of the gas into gas passage 21 from source 23 is controlled in a known manner as a function of the difference between the gas pressure in gas passage 21, measured by pressure transducer 24 and the outside ambient pressure. The pressure difference is generally about 2 to about 5 psi, and is preferably maintained at at least about 3 psi to provide a pressure barrier in the joint—that is, between mating surfaces 28 and 29—against ambient gas; pressure drop in duct 22 will vary depending on its length and internal diameter, but may be expected to be less than one-half psi and more likely about 0.2 psi. Mortar 25 fills the space between circumferential shoulder 26 on pour tube 8 and complementary circumferential rim 27 on tube holder 7. The mating surface 28 of tube holder 7 and mating surface 29 of pour tube 8 are preferably ground flat within a tolerance of 0.00125 cm to 0.03 cm. FIG. 3b provides the detail particularly of sealant 32 between porous refractory 20 and channel 19. The sealant should be a high temperature resistant sealant and serves to prevent the passage of gas from circumferential gas passage 21 into the joint below mating surface 28 without going through refractory 20.

A preferred variation of my invention is shown in FIG. 4a. In this version, it is seen that a circumferential shelf 30 is formed on the top of the pour tube 8 and a complementary overhang 31 is formed on the lower terminus of the tube holder 7. Behind the overhang 31—that is, concentrically external therefrom, a mortar relief groove 32 in the form of a deeper recess is provided to allow for spillage of mortar 25 during placement of the tube holder 7 on the tube 8. Circumferential channel 19 containing porous refractory 20 is similar to that in FIGS. 3a and 3b, and is also connected through circumferential gas passage 21 and duct 22 to gas source 23. As in the FIG. 3 embodiment, the flow of inert gas to channel 19 may be controlled as a function of pressure in gas passage 21 and ambient external pressures as determined by transducer 24. In any event, the effect of the open circumferential gas passage 21 is to provide a gas feed pressure substantially evenly around the circumferential channel 19. Preferably, care is taken during mortaring not to have an excess of mortar which could find its way into the horizontal portion of the joint (mating surface 29). This is further illustrated in FIG. 4b, in which it will be seen that mortar 25 has been carefully placed so as not to extend onto the horizontal area of mating surface 29 as the mating surfaces 28 and 29 of tube holder 7 and pour tube 8 are brought together.

In FIG. 5, tube holder 7 and pour tube 8 form a mortarless joint at mating surfaces 28 and 29 which have been ground flat to a tolerance of <0.03 cm. Channel 19 is formed in tube holder 7 as in the other figures and partially filled with porous refractory 20, leaving circumferential gas passage 21 available to conduct gas from duct 22 with even pressure on the upper surface of porous refractory 20, thus assuring its even distribution. In this configuration also, an optional centering ring 35 surrounds and reinforces the assembly, and metal banding 36 also is tightly fixed to the circumference of the upper portion of the tube 8. To prevent the ingress of ambient gas such as air from outside the assembly through the joint, an inert gas such as argon is fed through duct 22 at such a rate as to maintain a pressure difference between the ambient outside pressure and pressure in the circumferential channel of at least 3 psi.

Persons skilled in the art will realize that my invention minimizes the possibility of destruction of the seal between mating surfaces 28 and 29 by the migration of pieces of mortar; also my invention tends to assure that if any gas is drawn into interior through joint 15 (between mating surfaces 28 and 29 and through mortar 23), the gas is far more likely to be gas from source 23 than external air which may have seeped into joint 15 from behind shroud 17. The distribution of inert gas around gas passage assures that inert gas will be available with sufficient pressure to any point in the circumference of porous refractory 20.

The porous refractory I use for the channel insert may be any of the porous refractories known in the art, such as porous zirconia refractories or high-alumina porous refractory. In practice typically varying from one-quarter inch thick to three quarters inch thick, they should preferably provide no more than about 2 psi pressure drop (and in any event no more than about 4 psi pressure drop) when a standard inert gas such as argon is flowing through the insert at about 35 standard cubic feet per hour. The refractory may be formed in place in the channel or prefabricated and set into the channel with a sealant.

I claim:

1. A tube assembly for use in continuous casting of metal comprising (a) an elongated, generally cylindrical pour tube having an axial opening therethrough, said pour tube being generally vertically oriented and having a generally flat upper terminus, (b) a tube holder having an axial opening therethrough, said tube holder being fixed on top of said pour tube, having a generally flat lower terminus adapted to mate with said upper terminus of said pour tube, and having a circumferential channel in said flat lower terminus, said generally flat upper terminus of said pour tube and said generally flat lower terminus of said tube holder both being ground to a flatness having a tolerance of 0.03 centimeter, (c) gas supply means connecting said circumferential channel with a source of inert gas, (d) a porous refractory partially filling said circumferential channel throughout its circumference, leaving said circumferential channel partially open throughout its circumference and in connection with said gas supply means, whereby to form a gas feed passage to provide feed gas pressure substantially evenly around said circumferential channel in contact with said porous refractory, and (e) means for feeding inert gas from said source of inert gas to said circumferential channel as a function of the difference between pressure in said circumferential channel and ambient pressure outside said tube assembly.

2. Tube assembly of claim 1 including a circumferential shelf on the inner circumference of said tube which is lower than said upper terminus, and a complementary overhang on the inner surface of said tube holder, whereby, when said mating flat surfaces of said pour tube and said tube holder are in contact, said circumferential shelf and said circumferential overhang form a circumferential mortar space.

3. Tube assembly of claim 2 wherein said tube holder includes a mortar relief groove circumferentially in contact with said overhang and formed in said tube holder to a point higher than said generally flat lower terminus.

4. Tube assembly of claim 2 including mortar in said mortar space.

5. Tube holder of claim 1 including a shroud extending around both said tube holder and the upper portion of said pour tube, covering the said termini thereof.

6. Method of inhibiting the ingress of ambient gases through the joint of a continuous casting tube and tube holder, said joint comprising the interface of surfaces on said tube and tube holder each ground to a flatness tolerance of 0.03 centimeter, comprising inserting an inert gas into the joint through porous refractory which is in contact with said joint throughout its circumference by exerting an inert gas pressure evenly on the entire surface of said porous refractory said inert gas pressure being maintained at least 2 psi greater than ambient pressure.

7. Method of claim 6 wherein the pressure drop through the refractory is no more than 4 psi.

8. Method of claim 6 wherein the inert gas is argon.

9. Method of claim 6 wherein the difference between ambient pressure and the pressure on the upstream side of the refractory is at least three pounds per square inch.

* * * * *